United States Patent [19]

Schaeffer

[11] Patent Number: 4,962,491

[45] Date of Patent: Oct. 9, 1990

[54] MEDICAMENT DISPENSER AND MEDICAL INFORMATION STORAGE APPARATUS

[76] Inventor: Theodore S. Schaeffer, 86 Russell Ave., Rahway, N.J. 07065

[21] Appl. No.: 478,227

[22] Filed: Feb. 12, 1990

Related U.S. Application Data

[63] Continuation-in-part of Ser. No. 257,462, Oct. 13, 1988, abandoned.

[51] Int. Cl.[5] ..... G04B 47/00; B65B 59/00

[52] U.S. Cl. ..... 368/21; 221/15

[58] Field of Search ..... 368/10, 107–109; 221/2, 3, 15; 340/309.4, 309.15

[56] References Cited

U.S. PATENT DOCUMENTS

| | | | |
|---|---|---|---|
| 4,258,354 | 3/1981 | Carmon | 340/309.4 |
| 4,504,153 | 3/1985 | Schollmeyer | 368/10 |
| 4,682,299 | 7/1987 | McIntosh | 364/569 |
| 4,695,954 | 9/1987 | Rose | 364/413.01 |
| 4,768,177 | 8/1988 | Kehr | 368/10 |

*Primary Examiner*—Vit W. Miska

*Attorney, Agent, or Firm*—Robert D. Farkas

[57] ABSTRACT

A portable medicament dispenser and patient medical information storage apparatus utilizes a housing containing external access to an alpha/numeric keyboard, a visual display having a clock display, an alpha/numeric display portion, and a plurality of control function keys which may be used to enter the name of medicaments and the times that they should be taken throughout the day, coupled to a memory storage mechanism. An audio device enunciates the time in which all of the medicaments, in bulk quantity, contained within a compartment of the apparatus, may be retrieved by the user. A cover, over the compartment, opens automatically at the times that any medicaments are to be taken by the user, who then selects those medicaments he is to take at that time. By programming the keyboard, patient information may be inserted into the storage mechanism, for use during emergencies. A stationary device, similarly equipped with an alpha/numeric display and keyboard coupled to a storage mechanism, may be used to program the portable device at the source where medicaments are dispensed. An output terminal of the stationary device may simultaneously print labels for the dispenser. Another output device may be utilized to provide information for memory storage concerning price, medicament, directions for use, doctor's name, and the like, in the dispenser's file on the patient. By coupling the two units, the portable unit and the stationary unit together, the dispenser may similary control the new or re-programming of the memory of the portable unit, thereby eliminating the need for manual programming into memory for same by the user.

11 Claims, 3 Drawing Sheets

PORTABLE UNIT

STATIONARY UNIT

MEDICAMENT DISPENSER AND MEDICAL INFORMATION STORAGE APPARATUS

This application is a continuation-in-part of application Ser. No. 07/257,462, filed Oct. 13, 1988, now abandoned.

BACKGROUND OF THE INVENTION

1. The Field of the Invention

This invention relates to medicament dispensers and storage devices and time enunciators in combination.

2. Description of the Prior Art

The prior art abounds with a wide range of technology for the storage and retrieval of information, utilizing alpha/numeric keyboards. In addition, pill storage devices, such as portable containers, are well known. Combinations of pill boxes and portable clocks are well known. Though there have been devices, such as bracelets and pendants, containing thereon medical information or containing code numbers which signify an identifier of the patient, such code numbers being useful in telephonically retrieving patient information, there are no devices which can indicate to the patient the time of designated use, a description of the medicament to be used which is easily setable and resetable and modified from time to time, by the apparatus or by a remote apparatus used to control same. Portable alarms which respond at preset intervals are well known. The combination of an audible alarm, coupled with a visual display which signifies alpha/numeric data, in combination with a medicament dispenser containing a compartment holding a bulk variety of medicaments, is novel.

SUMMARY OF THE INVENTION

A primary object of the present invention is to provide a portable medicament dispenser which is capable of enunciating visually and audibly at the times that any given single or number of medicaments are to be taken, indicating to the user, simultaneously therewith, data relative to the type and numbers of medicaments to be then used.

Another object of the present invention is to provide a portable medicament dispenser which contains a readily accessible medicament compartment, closed at all times, but opened automatically at those times that medicaments are to be taken.

Still another object of the present is to provide a portable medicament dispenser which may be programmed from a stationary controller into memory so as to preclude the need for a user to program the portable apparatus.

Yet another object of the present invention is to provide an apparatus which is capable of presenting stored patient information which may be carried about by the patient at all times and which is readily accessible by others.

Still another object of the present invention is to provide a stationary controller which may be used to permit the dispenser of medicaments or the physician to output stored data therefrom to another storage device, thereby permitting the dispenser or physician ability to keep track of the medicaments then prescribed or dispensed and dispensed or prescribed at prior times.

A further object of the present invention is to provide a stationary controller which, in combination with a printer, is useful in printing labels for affixing upon medicament containers whilst simultaneously programming the memory of a portable medicament dispenser.

Yet another object of the present invention is to provide a portable medicament dispenser, small in size, rugged in construction, reliable in operation, which is inexpensive in its manufacture.

Medicament taking requires the competent patient to keep track of time, understand the label instructions, and reliably and uniformly take the proper dosage at designated time intervals. Patient compliance is a frequent complaint of physicians and druggists, resulting oftentimes in far less than the routine and regular taking of drugs when ordered to do so by the physician. Because of such problems, patients oftentimes fail to receive the maximum benefit of the medications and, as a result thereof, oftentimes can receive ineffective treatment, sometimes creating an actual threat to life. For example, insulin patients, failing to take insulin at routine intervals, may suffer attacks. Similarly, patients who are ordered to taper off from certain medicaments, sometimes are found to be in life-threatening situations when they abruptly stop the taking of medicaments. The reverse is also true.

As a means to overcome these problems, the present invention envisions a portable apparatus which, if desired, contains a medicament storage compartment. The apparatus also includes a form of visual display. One form of visual display is adapted to indicate the type of medicament, either by name or physical description. Thus, for patients who are elderly and cannot remember the name of the drug to be utilized, a description such as "red pill" or "large white tablets" may be used. In addition, the visual display would indicate the number or amount of medicament to be taken, such as "2" or "1 oz."

As a means of locking out purposeful or accidental access to the medication compartment, which stores a variety of medicaments in the common compartment, the access cover is locked each time the compartment is manually closed. The access cover cannot be opened until the timing mechanism reaches prescribed points in real time and an alarm signals that, at this point in real time, one or more medicaments are to be taken. A spring is attached to the housing and exerts a force upon the access cover so as to pivot the access cover in an open position at the time that the alarm first sounds. The access cover is maintained in a closed and locked position by a tongue that is spring loaded to retain the access cover locked, until the tongue is momentarily retracted on the sounding of the alarm at the time that medication is to be taken. When the tongue is allowed to return to its normal position, the access cover will have been opened by the spring and the access cover will remain open until it is manually closed and locked by the return of the tongue to its normal position, locking the access cover until the next point in real time that medications are to be taken. If it is desired to open the access cover at any time other than a normal time to take medicaments, such as would be needed at various times to fill or refill medicaments into the compartment, the user may do so by operating selected keys on the alphanumeric keyboard.

One of the problems experienced in the design of medicament dispensers is their use with patients that cannot select the proper medicaments to be taken at any one time. It is easily seen that that kind of medicament dispenser that mandates that only a professional must select the specific drugs to be dispensed at any one time, by the placement of such selected drugs in a separate compartment, requires that a doctor, nurse or pharmacist perform a task that could easily be completed by a more competent patient simply selecting the appropriate medicaments from all of the various medicaments stored in quantities greater than needed for use at any one medicament taking time, all stored in the same compartment. The present invention precludes frequent filling operations by nurses and the like, due to the limited number of compartments available in the equipment. For example, a multiple compartment type of device, having 12 compartments, would require refilling by a professional every 24 hours if the medicaments are to be taken at 2 hour intervals. The present invention permits the loading of virtually any quantity of each medicament in the compartment or compartments covered by the single access cover. The more competent patient simply selects the desired medicaments by type and quantity, guided by the instructions on the visual display.

The visual display may also describe the medicament to be taken by a visual display of time, which display could, if desired, continuously indicate the time and, at the appropriate time in which a medicament is to be taken, signify this by the addition of a symbol or by flashing the display on and off at routine intervals, in a manner well known to the art. The display could also be utilized to be energized and active only at those time periods when medicaments are to be taken. The alpha/-numeric visual display portion of the apparatus not devoted to the display of time could also be useful to display such information as the patient's name, address, age, diagnosis of medical condition, the name and address and telephone number of any individual to contact in case of emergency, and similar emergency-related information. An alpha/numeric keyboard is useful in programming into memory all information contained in the visual display.

An audible device, such as a speaker or buzzer-like device, may be employed, activated at the time or at a later time in which the visual time display begins to signal to the user that it is time to take a medicament.

A mute button may be employed to terminate the use of the audible device and to terminate the flashing or signalling function of the portion of the visual display, signifying to the apparatus that the signalling functions of the audible device and the visual display need not continue in their operation thereafter, as by the user having taken the necessary indicated medicament.

As a part of the portable medicament dispenser, a receptacle would be provided which is capable of coupling an output signal from its memory bank to a stationary medicament and patient medical information control unit. Such stationary medicament and patient medical information control unit is adapted to be utilized by physicians and druggists alike. In its use, the stationary control unit has its alpha/numeric keyboard operationally coupled to the memory bank and also controlling the visual display board. By proper programming techniques, as will be explained, the physician or druggist can not only program the memory bank of the portable medicament-dispensing apparatus when coupled to the stationary medicament and patient medical information control unit, but can if desired provide a permanent record within an exterior memory unit, well known in the art, for purposes of the storage of patient information. Additionally, an output terminal of the stationary control unit can be fed to a printer, if desired, such that the printer can prefabricate labels or stickers for affixing to the medicament container that is dispensed to the patient or for attachment to a portion of the patient's records. Thus, the physician will always have available to him copies of the drugs that he has dispensed or prescribed to the patient, whilst simultaneously programming the patient's portable medicament dispenser, thereby eliminating the absolute need for the patient to perform a programming function himself. Alternatively, the druggist can prepare, if desired, labels for attachment for bottles, jars, tubes, and packages containing the medicaments whilst he, in a similar fashion to the physician, updates the patient's profile of drugs taken, the doctor who ordered same, the dosage, and the times in which they should be taken.

The portable medicament dispenser and patient medical information storage device may be battery operated, in a manner well known in the art, utilizing rechargable or disposable batteries as desired. The stationary medicament and patient medical information control unit may be operational utilizing alternating current power sources and is designed so that it too can read out all of the stored information contained within the memory bank of the portable medicament dispenser, thereby precluding the physician or druggist from utilizing the relatively smaller and less visually accessible visual displays of the portable device to gain access to the stored data therewithin.

These objects, as well as other objects, of the present invention will become more readily apparent after reading the following description of the accompanying drawings.

DESCRIPTION OF THE PREFERRED EMBODIMENT

Figure 1:
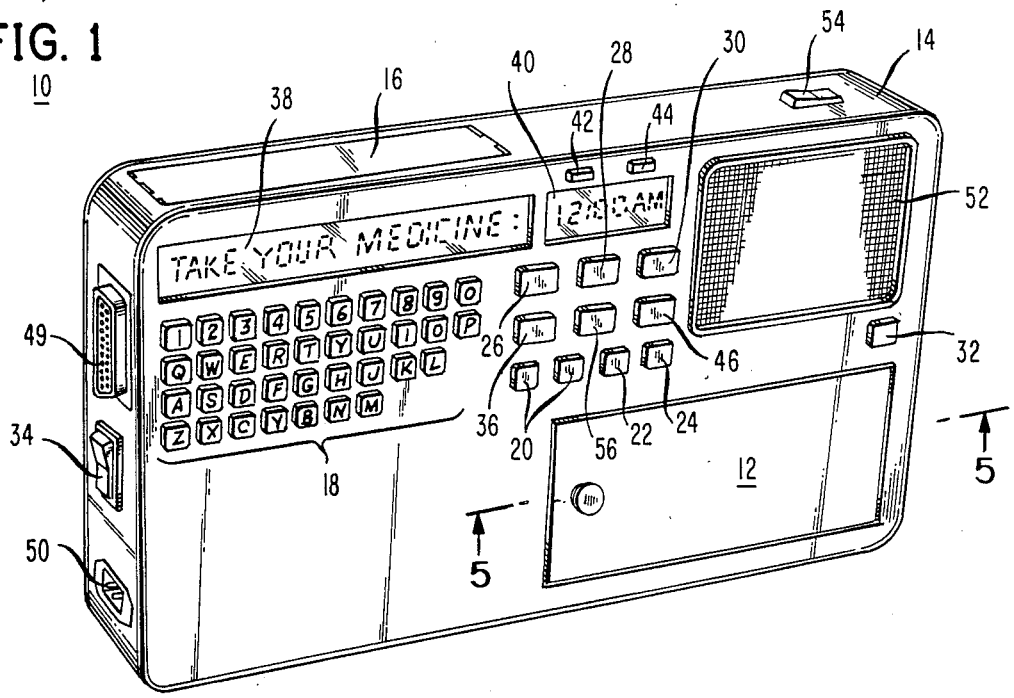
FIG. 1 is perspective view of the portable medicament dispenser and medical information storage device.

The structure and method of fabrication of the present invention is applicable to portable medicament dispensers and patient medical information storage devices and control units. The portable unit comprises a small, compact, and light unit having, if desired, a compartment for the storage of medicaments. For those medicaments which are too large to be contained within the storage compartment, the patient would be required to have ready access to same when carrying the portable unit about. The portable unit utilizes an alpha/numeric keyboard coupled to a memory bank and computer, which keyboard contains 36 keys, each bearing a letter of the alphabet and ten numerical keys, for inclusions of the numbers 1 through 9 and 0. In addition, the portable apparatus is equipped with two visual displays, which displays may be consolidated into one, if desired. The display portions of the portable apparatus are designed to display information retrieved from the memory bank, at given time intervals, illustrating time and alpha/numeric information concerning the patient or the medicaments which the patient is to utilize. By programming the alpha/numeric keyboard appropriately, upon the use of an "enter" key, such information is programmed into the random-access memory bank of the portable unit, in a manner well known in the art. A "cancel" key is similarly utilized to wipe out memory of any specific portion of the memory bank that appears on the visual display. An "advance" key is utilized to sequentially access the information contained within the memory bank for display purposes and correction purposes. A "stop access" key, once depressed, stops the continuous cyclic advancement of information displayed on the visual display. A "patient information" key, if included, provides only access to that portion of the memory bank which contains information about the patient, as opposed to the medicaments which the patient is to use. The clock portion of the visual display, whether it be combined with the patient information or the medicament description portion of the visual display or be it a separate portion of the visual display, may be altered upon depressing an a.m. or p.m. button which would optically signify a.m. or p.m. to the user at the appropriate times. Two buttons, one labeled "hours" and the other labeled "minutes," would be utilized to advance the clock portion of the apparatus. In its function, the clock portion of the apparatus would continuously run time, such that when the time portion of the visual display displays time, it would be the actual time.

A speaker or other audible device such as a buzzer is also provided. Such speaker would be activated at times pre-set into memory by the alpha/numeric keyboard, suggesting that if the user does not take the medicament at the prescribed times as indicated on the time portion of the visual display, the audible alarm would sound for a pre-determined period of time. A mute button would be provided, which mute button resets and stops the flashing function of the time device signifying, then, the appropriate time to take a medicament is over, and similarly, mutes the speaker from operation or for operations which are then being enunciated.

The apparatus is also adapted to include a suitable on/off operational switch, which switch would permit the apparatus from not draining its battery source to which it is coupled, when not in use. A battery compartment would be provided for the use of rechargable or one-time use of batteries. A first port is included which is adapted to accept a battery charger output connector. Another port is provided for coupling to the stationary medicament and patient medical information control unit.

The stationary control unit is adapted to program the memory bank of the portable unit in the same manner that the memory bank of the portable unit can be programmed, save for setting the actual time on the portable unit and the mute function of the speaker and time visual display. This is accomplished by a first receptacle that is coupled to the portable unit when the portable unit is to be programmed by the stationary control unit. The stationary control unit is similarly equipped with an alpha/numeric keyboard, an "a.m./p.m." entry button, a "start/enter" key, a "final/enter" key, an "advance" or "read" key, and a "print/operate" key. The "start-/enter" key is useful in signalling the entry of data to be recorded into the portable unit and for other purposes. The "final/enter" key signifies the completion of the storage of information operation, thereby placing such information into storage in the RAM of the portable unit. In use, the portable unit would be set to read a specific medication, either because such medication has been pre-programmed into the portable unit prior to the time of this entry, or, for the first time, by this entry. In any event, once the medicament is programmed or retrieved by visual display on the portable unit, the control unit may activate the portable unit so as to amend, modify, or cancel the old information by pressing the "start/enter" key, signifying an input function of the I/O to accept data. The "final/enter" key will reprogram the portable unit and store into RAM of the control unit the data just entered into it.

The stationary control unit also has an output terminal which can be coupled to a label or sticker printer, for use of the physician or druggist.

The stationary control unit is equipped with an output terminal which may be coupled to external storage devices such as hard disks, floppy disks, tape drives, or various other media storage devices useful to store a profile on the patient or customer. Depressing the "print operate" key permits the information stored into RAM of the control unit at a time between depressing the "start/enter" key and the "final/enter" key to be stored and/or printed.

The control unit is adapted to operate on an alternating current power source and, because of its simple programming and use instructions, would permit a user relatively unskilled in the operation of sophisticated electronic devices to operate same with relative ease and convenience.

Now referring to the Figures and more particularly the embodiment illustrated in FIG. 1 showing the portable medicament dispenser and patient medical information storage device 10 of the present invention as a compact device having a medicament compartment access cover 12 which is hingeably secured to the housing, covering the open mouth portion of a compartment in which small medicaments may be placed. Not shown is the compartment portion of the apparatus which may bifurcated into several compartments, if desired. If separate compartments are employed, the access cover covers all compartments, exposing the single or multiple compartments when the single access cover is in the open position.

The housing 14 itself may be fabricated from plastic or metal, or any other suitable material. A battery-access cover 16 is provided covering a battery compartment for the use and inclusion of rechargeable or throw-away batteries. An alpha/numeric keyboard 18 is attached, having 36 keys or buttons judiciously labeled and marked for easy identification. As described herein, the words buttons and keys, used interchangably, refer to mechanical activators for switches not shown, which are coupled to a controller, not shown. In addition to these keys are "a.m./p.m." buttons 20, a "data entry" button 22, a "time entry" button 24, an "enter" button 26, a "cancel" button 28, a "correct time" button 30, a "read" button 32, an "on/off" button 34, and a "stop access" button 36. These buttons control the time in which data is entered or time is entered, the "time entry" button 24 controlling the time in which the medicament is to be taken, as opposed to the "a.m./p.m." buttons 20 which are used to set the clock portion of the visual display. The visual display as shown may consist of two LED sections 38 and 40, section 38 for the display of character-like information, whilst section 40 may be used for the numeric display, or time display, and may be separate from 38. The time display portion could, if desired, indicate a.m. and p.m. by the inclusion of a dot or the symbols a.m. and p.m., not shown. Alternately, in an alternate embodiment, a single visual display may be utilized which alternately displays time and character-like information, not shown. An "hour set" button 42 and "minute set" button 44 are provided to set the internal clock of the mechanism such that the time displayed on the visual display 40 will be accurate and local.

The "enter" button 26 is provided, which button, upon its depression, permits the entry of time of alpha/-numeric characters concerning the medicaments or patient information. The "cancel" button 28 would wipe out from RAM, not shown, the technical information then being displayed by the visual display, concerning character-like information, but not time.

A "correct time" button, not shown, would be used, if desired, such that the "hour" and "minute" buttons may be adjusted when same is depressed, thus eliminating the need for button 24. The "on/off" button 34 is utilized to turn on the apparatus and turn it off for periods of time when the apparatus is not in use to conserve battery life. The "stop access" button 36 serves the opposite function to an "enter" button 26, which terminates the ability to access information from RAM.

An "advance" button 46, on each single depression, would advance the characters displayed of the characters displayed on the visual display, permitting an entire review of all information stored in RAM sequentially, as desired. Thus, a user may optically review his entire medical information from time to time, and at any time during the day or night by depressing the "advance" button sequentially to determine times to be used and all the medicaments that he has to take during any 24-hour period. "Read" button 32 is used to operate the displays 38 and 40 only when depressed.

Output terminals 49 are provided on the portable medicament dispenser and patient medical information storage device for coupling to RAM from an output signal from the stationary medicament and patient medical control unit. In addition, a terminal 50 is provided for the use of a battery-charging device, well known in the art. An audible device 52, such as a speaker, buzzer, or bell, is provided in the portable storage device, which speaker is activated at a short-time interval following the beginning of the signalling of the time to take a medicament by the visual time display. Such speaker may be muted by the depression of a "mute" button 54, which "mute" button, once depressed, similarly terminates the flashing function of the time display and the visual display indicating the medicament to be used.

At no time will the patient information be displayed unless the patient information button 56 is depressed.

Thus, a user, utilizing the portable dispenser portion of the present invention, will see—in one embodiment of the present invention 10, at least—time displayed continuously in a steady fashion, a.m. and p.m. would similarly be indicated. At preset time intervals, fully adjustable by the user, the visual display will activate, telling the user what medicament and the quantity of the medicament to be utilized. At such time, the time display may similarly flash or signal the time to the user. Following same, after a short preset time interval, the audible alarm will sound. The audible alarm will sound until the 37 mute" button is depressed. If desired, the access cover to the medicament access container portion of the present invention may operate by activating the "mute" button, thereby eliminating its manual use.

Figure 2:
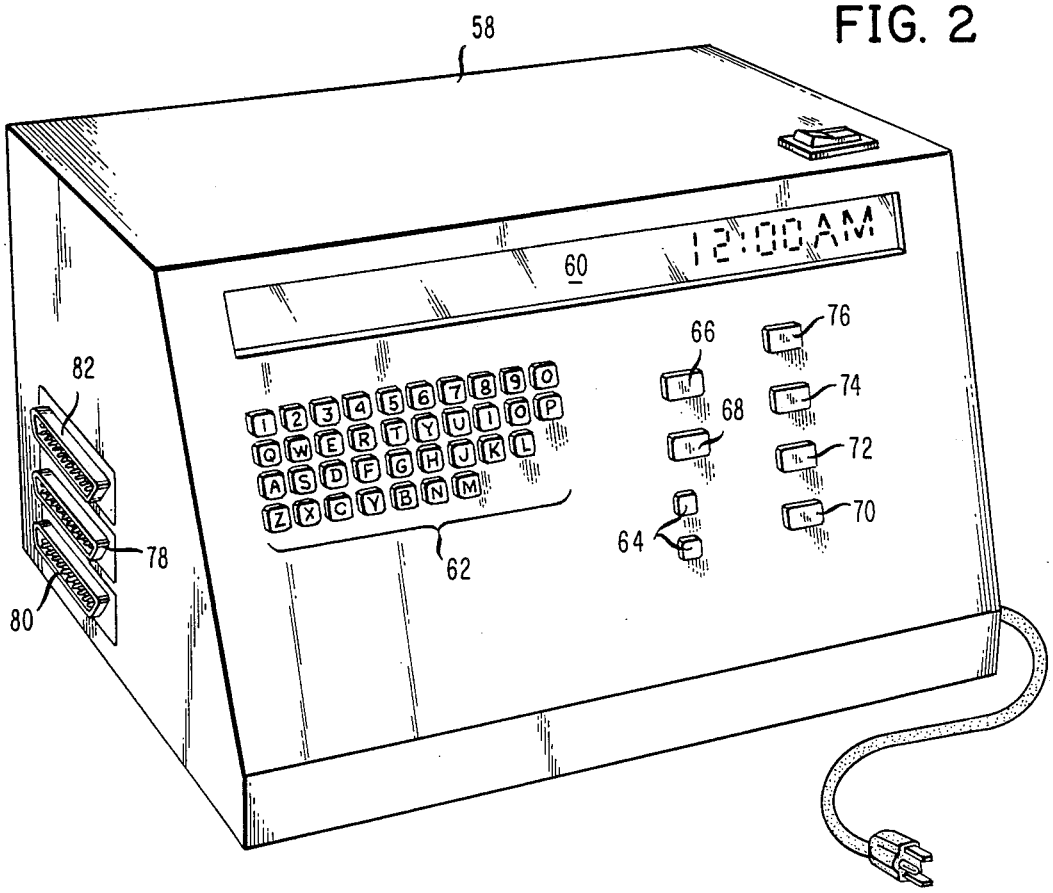
FIG. 2 is a perspective view of the stationary medicament and patent medical information control unit.

FIG. 2 illustrates the stationary medicament patient medical information control unit 58 utilizing a visual display 60, which may comprise, if desired, a continuous time display. Such time display may be on at all times that the apparatus is energized, permitting the user of same, a druggist or physician or hospital, to note the time. An alpha/numeric keyboard 62 is similarly provided, which permits the technician or physician or nurse to program into random access memory information concerning medicaments, dosages, and time. Similarly, "a.m./p.m." buttons 64 are provided, which "a.m./p.m." buttons signify a.m. and p.m. for the use of drugs that are intended to be taken in the morning or evening. A "time entry" button 66 is included such that the information provided via the alpha/numeric keyboard 62 may be programmed into the random access memory, not shown, of the portable unit 10, causing the speaker 52 and the visual time display 38 and 40 to operate at the appropriate times. A "data entry" button 68 is similarly provided, which button is operated prior to the entry of alpha/numeric information concerning medicaments of patient information. A "start/enter" key 70 and a "final enter" key 72 are employed alternately during periods at the beginning and ending of information entry by the technician, physician, druggist, or hospital staff. At the operation of the "final enter" key 72, information is programmed into RAM of the portable unit and signifies completion of a total information entry cycle. An "advance/read" button 74 is provided, which button when operated extracts from random access memory on the portable unit the information contained in the portable unit sequentially, such as medicaments and their dosages, inclusive of patient information. A "print operate" button 76 operates in conjunction with receptacle 78 which is coupled to a label or sticker printer, useful in the preparation of medicament container labels and stickers for forming part of hospital or physician's records. Another receptacle 80 is provided for purposes of providing a cable-like coupling to portable unit 10 useful in programming the portable unit and reading from it information then stored within it. A third receptacle 82 is provided which is used to program into patient storage, in sequential form, all information concerning the patient's medicament profile as well as the patient's significant illnesses and other medical information. Thus, a physician, in the typical use of the stationary medicament and patient medical information control unit 58, if desired, may be able to have a rapid way of describing drugs, their use, the time of their use, as patient information, all at one time, by the operation of the control unit itself.

Nothing in the present invention is intended to indicate that the portable medicament dispenser and patient medical information storage device 10 must be used in combination with the stationary medicament and patient medical information control unit 58. Rather, the portable device 10 may be utilized fully independently of and never in association with the stationary medicament and patient medical information control unit 58.

Figure 3:
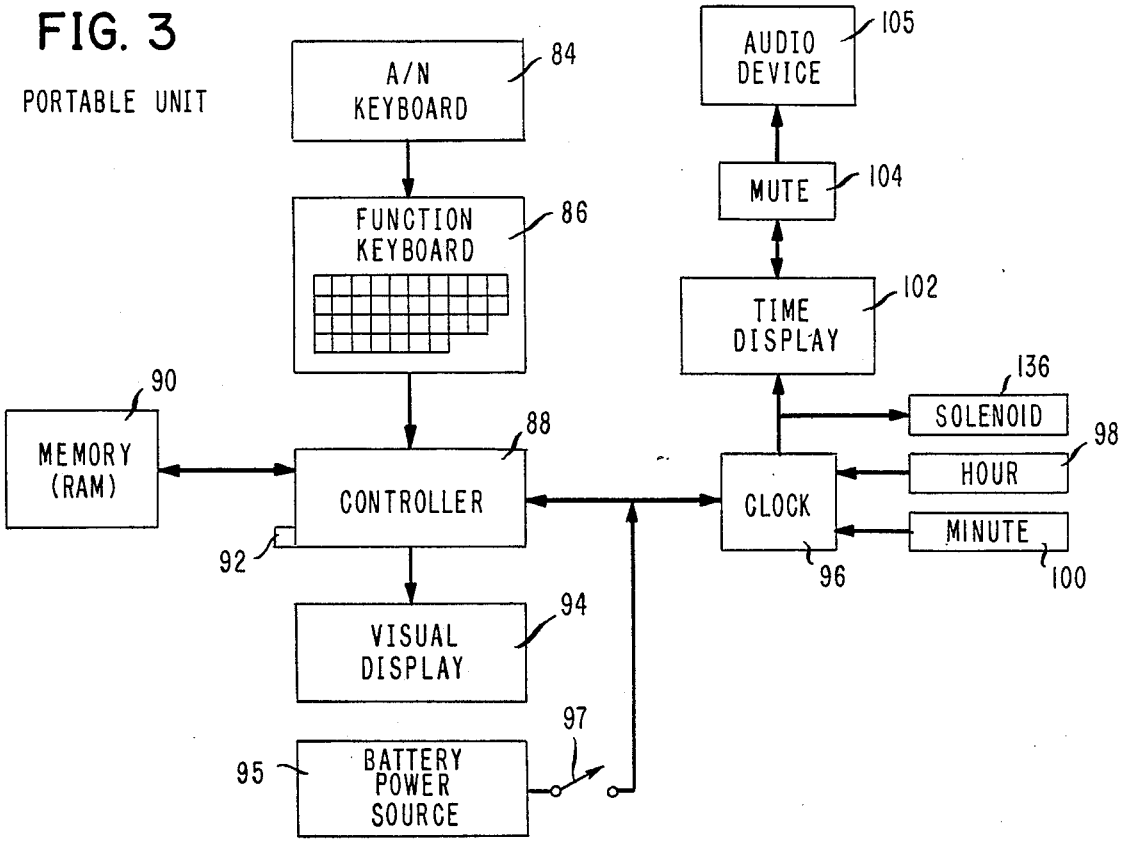
FIG. 3 is block diagram of the functional elements of the apparatus described in FIG. 1.

FIG. 3 illustrates a block diagram of the portable medicament dispenser and patient medical information storage device, utilizing an alpha/numeric keyboard 84 as well as function keyboard 86, both of which are useful in programming memory bank 90, preferable of the random access memory type, well known in the art. The controller 88 is utilized to couple up the alpha/numeric keyboard 84, the function keyboard 86, and the memory bank portion of the present invention. Controller 88 is also adapted with a receptacle 92 which provides input information to the random access memory bank 90 from the stationary medicament and patient medical information control unit 58, when desired. The visual display 94, as shown, is separate and apart from a time display, not shown, but may be combined into one display, if desired. Battery power source 95 in combination with switch 97, when closed, provides operating power to the portable unit. A real time clock 96 feeds its output to the controller 88 and may be reset by hours and minutes by the utilization of buttons 98 and 100 respectively. A time display 102 is illustrated, which reads actual current time as determined by the clock 96. A "mute" button 104, when depressed, turns off the time display in terms of its flashing characteristic or special characteristic such as an asterisk, or the like, not shown, indicating that it is time to take a medicament and, when the audible alarm 105 sounds, sounding somewhat delayed thereafter, is operational. Similarly, the operation of the "mute" button 104 would turn off the visual display 94, such that the medicament and its dosage then described would similarly deactivate. Solenoid 136, when energized, is used to unlock access cover 12, shown in FIG. 1, at a time that medicaments are to be taken by the patient, by permitting cover 12 to open.

Figure 4:
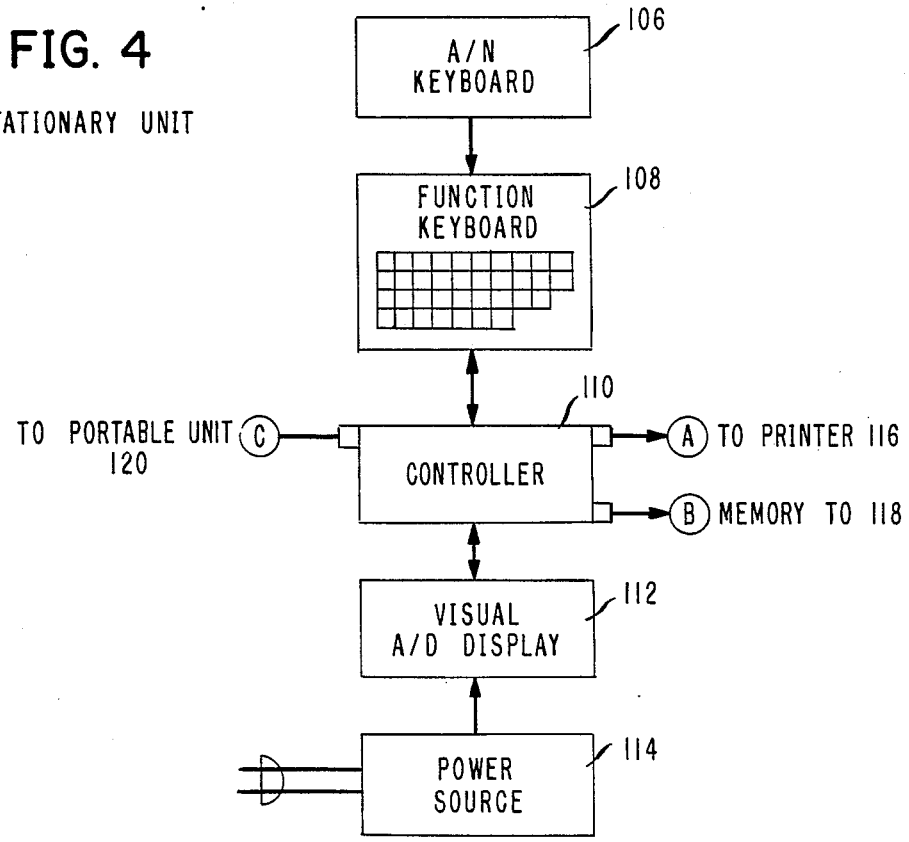
FIG. 4 is a block diagram of the functional elements of the apparatus described in FIG. 2.

FIG. 4 is a block diagramatic embodiment of a stationary medicament and patient medical information control unit 58 utilizing an alpha/numeric keyboard 106, a function keyboard 108, a controller 110, a visual alpha/numeric display 112, and a power source 114. The controller is adapted with three terminals, 116, 118, and 120, the first of which 116, is a printer terminal providing output information to a printer, not shown. The second memory output terminal 118 is for use in other forms of magnetic media for storing the information programmed into it by the alpha/numeric keyboard 106 and modulated by the function keyboard 108. The third output terminal 120 is useful in coupling the stationary medicament and patient medical information control unit 58 to a portable unit 10, if desired.

Figure 5:
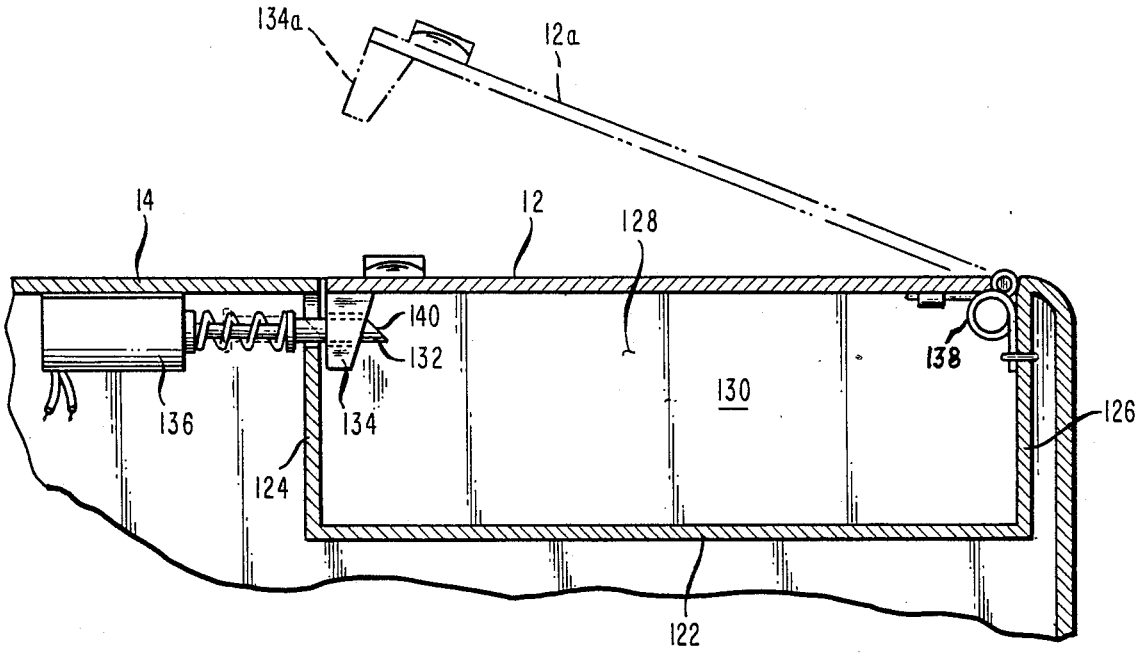
FIG. 5 is a cross-sectional view of a portion of the apparatus shown in FIG. 1.

FIG. 5 illustrates a cross-sectional view of a portion of the apparatus shown in FIG. 1. Compartment 128 is formed by base 122 and side walls 124 and 126. Rearmost wall 130 and an opposing wall, not shown, defines a totally closed compartment if access cover 12 is in the closed position shown. When access cover 12 is in the open position it is the position shown by dotted lines 12*a*. Tongue 132 is shown engaged with an opening in plate 134. When in the position shown, tongue 132 locks the access cover and prevents access to the contents of compartment 128. When tongue 132 is retracted by the momentary operation of solenoid 136, at any designated time for the user to take medicaments, tongue 132 moves out of engagement with plate 134, permitting spring 138 to open the access cover into the position shown by dotted lines 12*a*, exposing the single or all multiple compartments for the removal or refilling of medicaments. The tongue is spring loaded, in conventional fashion, such that the manual closing of the access cover, causes the lowermost edge of plate 134 to displace tongue 132 by a sliding process along ramped surface 140 of tongue 132. Tongue 132 is the able to then engage the opening of plate 134, sliding into such opening and remaining in the opening until the next energization of solenoid 136.

The preceeding spring loaded access cover locking mechanism, described herein may also if desired include a knob being attached to the exterior surface of the access cover, to permit easy opening of the access cover, in the event that spring 138 is unable to open the access cover into the position shown by dotted lines 12*a*.

A primary advantage of the present invention is to provide a portable medicament dispenser which is capable of enunciating visually and audibly at the times that any given single or number of medicaments are to be taken, indicating to the user, simultaneously therewith, data relative to the type and numbers of medicaments to be then used.

Another advantage of the present invention is to provide a portable medicament dispenser which contains a readily accessible medicament compartment, closed at all times, but opened automatically at those times that medicaments are to be taken.

Still another advantage of the present is to provide a portable medicament dispenser which may be programmed from a stationary controller into memory so as to preclude the need for a user to program the portable apparatus.

Yet another advantage of the present invention is to provide an apparatus which is capable of presenting stored patient information which may be carried about by the patient at all times and which is readily accessible by others.

Still another advantage of the present invention is to provide a stationary controller which may be used to permit the dispenser of medicaments or the physician to output stored data therefrom to another storage device, thereby permitting the dispenser or physician ability to keep track of the medicaments then prescribed or dispensed and dispensed or prescribed at prior times.

A further advantage of the present invention is to provide a stationary controller which, in combination with a printer, is useful in printing labels for affixing upon medicament containers whilst simultaneously programming the memory of a portable medicament dispenser.

Yet another advantage of the present invention is to provide a portable medicament dispenser, small in size, rugged in construction, reliable in operation, which is inexpensive in its manufacture.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A medicament dispenser and medical information storage apparatus comprising a housing, said housing having an alpha/numeric keyboard affixed thereto, said housing having at least one visual information display secured to said housing, a plurality of control function keys affixed to said housing, a controller, said alpha/numeric keyboard and said plurality of control function keys coupled to and electrically operating said controller, an audio device, said audio device coupled to said controller, means by which at least a portion of said visual information display is operable at selected points in real time inclusive of means to maintain said portion of said visual information display operable until a manual operation of one of said plurality of control function keys, means to maintain another portion of said visual information display operable at all times, said housing having a compartment, said compartment being configured having an access cover hingeably secured to said housing to accept for temporary storage therewithin a plurality of medicaments of various types and quantities, a spring loaded locking mechanism, said locking mechanism being secured to said housing, means whereby said locking mechanism is momentarily operated at said selected points in real time permitting the opening of said access cover so as to provide access to said plurality of medicaments stored within said compartment, means whereby said locking mechanism locks said access cover upon the manual closing of said access cover after selected medicaments are withdrawn from said compartment.

2. The apparatus as claimed in claim 1 wherein said audio device is secured to said housing, means to operate said audio device when said portion of said visual information display is operated, manual means to terminate the operation of said audio device only after the closing and locking operation of said access cover.

3. The apparatus as claimed in claim 1 further comprising a memory storage device, said memory storage device having random access memory capabilities, said memory storage device being coupled to said controller.

4. The apparatus as claimed in claim 1 further comprising an output terminal, said output terminal coupled to said controller, said controller having means to divide output signals provided to said output terminal.

5. The apparatus as claimed in claim 1 wherein said portion of said visual information display includes means to display and describe medicaments and quantities of medicaments to be taken and other patient information and other information, said another portion of said visual information display includes means to display real time.

6. The apparatus as claimed in claim 1 further comprising a battery, a switch, said battery coupled to said switch, said switch coupled to said controller.

7. The apparatus as claimed in claim 1 further comprising means to disable said audio device from continued ongoing operation.

8. The apparatus as claimed in claim 1 further comprising a stationary device, said stationary device having secured thereto another housing and another alpha/numeric keyboard and another plurality of control function keys and another controller, said another plurality of control function keys and said another alpha/numeric keyboard coupled to and electrically operating said another controller, another visual information display, said another controller coupled to said another visual information display, a power source, said power source coupled to said another controller, means to electrically couple said controller and said another controller.

9. The apparatus as claimed in claim 8 further comprising a printer output terminal, said printer output terminal coupled to said another controller, means to provide printer output data from said another controller to said printer output terminal.

10. The apparatus as claimed in claim 8 further comprising a memory output terminal, said memory output terminal coupled to said another controller, means to provide memory output signals from said another controller to said memory output terminal.

11. The apparatus as claimed in claim 8 wherein said another visual information display comprises at least two portions, one portion of said another visual information display includes means to display medicaments and patient information and other information, another portion of said another visual information display includes means to display real time.

* * * * *